United States Patent [19]

Johnson et al.

[11] Patent Number: 5,033,219

[45] Date of Patent: Jul. 23, 1991

[54] MODULAR LASER AIMING SYSTEM

[75] Inventors: Acie J. Johnson, Pine Bluff; Glenn W. Prentice, Little Rock, both of Ark.

[73] Assignee: Emerging Technologies, Inc., Little Rock, Ark.

[21] Appl. No.: 476,623

[22] Filed: Feb. 6, 1990

[51] Int. Cl.[5] ..... F41G 1/35; F41G 1/387

[52] U.S. Cl. ..... 42/103; 42/101; 33/248; 362/289

[58] Field of Search ..... 42/103, 101; 362/259, 362/289; 33/246, 248

[56] References Cited

U.S. PATENT DOCUMENTS

| | | | |
|---|---|---|---|
| 2,645,855 | 7/1953 | Ivy | 42/101 |
| 3,040,433 | 6/1962 | Heinzel | 33/246 |
| 3,823,313 | 7/1974 | Unema | 362/259 |
| 4,026,054 | 5/1977 | Snyder | 42/103 |
| 4,161,076 | 7/1979 | Snyder | 42/103 |
| 4,295,289 | 10/1981 | Snyder | 42/103 |
| 4,313,272 | 2/1982 | Matthews | 42/103 |
| 4,707,044 | 11/1987 | Jimenez et al. | 362/110 |
| 4,738,044 | 4/1988 | Osterhout | 42/103 |

FOREIGN PATENT DOCUMENTS

| | | | |
|---|---|---|---|
| 998212 | 7/1965 | United Kingdom | 33/246 |

*Primary Examiner*—Michael J. Carone

*Attorney, Agent, or Firm*—Stephen D. Carver

[57] ABSTRACT

The modular aiming device comprises an elongated laser module operatively linked to a rechargeable power pack module. Rigid, quick-release clamps permit the hunter to mount the device alternatively upon an existing dove-tail scope mount or upon a pre-mounted optical telescope sight. A plurality of adjustable, padded scope rings may be employed to axially engage telescope sights of different diameters. A laser emitter diode is anchored within a tubular sleeve axially, adjustably disposed within the rigid laser housing. The laser sleeve comprises an asymmetrically planned, tubular, internally threaded shaft. Screw-driven, spring-biased, angular wedges associated with the sleeve cooperate with resilient flat springs to provide precision elevation and windage adjustments. Thumbscrew adjustments functioning as worm gears drive the wedges to tilt the laser sleeve horizontally and vertically relative to the laser housing. Each thumbscrew is biased by a tension spring which generates an audible click in response to fractional turning of the adjustment thumbscrew.

21 Claims, 6 Drawing Sheets

MODULAR LASER AIMING SYSTEM

BACKGROUND OF THE INVENTION

The present invention relates generally to laser aiming devices for weapons such as compound bows, crossbows, handguns, rifles, shotguns, or muzzle-loaders. More specifically, the present invention relates to a quick-mounting, modular laser aiming system for firearms capable of precision windage and elevation adjustments for accurate shooting.

Optical sights such as telescopic rifle scopes have long been in use by hunters for improved sighting. Optical sights involve the development of unique visual skills by the hunter. Typical scopes comprise an optical sighting tube mounted above and parallel to the rifle barrel. A sighting grid is defined within the tube by crosshairs or similar markings. The scope is positioned above and parallel to the gun barrel, so that the scope line of sight extends generally parallel to the line of fire extending from the gun barrel. When a scope is mounted, it must be "sighted-in" before use.

Ideally it is desired to mechanically position the scope cross hairs so that they cross exactly in the middle of the field of view. After course mounting adjustments are made, "fine tuning" of the cross-hair mechanisms will follow. The scope must be adjusted for "elevation" so that the telescopic line of sight converges with the line of fire (i.e. the bullet's impact point) at the target area a predetermined distance from the gun. Elevation adjustments are commonly made, for example, to adjust for varying target ranges. Elevation adjustments are needed when the rifleman switches between different cartridges, which may vary in bullet weight and powder characteristics. Typical scopes also readily facilitate "windage" adjustments to compensate for crosswinds which result in lateral displacement of the fired bullet. Thus, a target shooter employing optical sights of this kind may estimate the firing distance to the target, adjust the scope elevation for the proper distance, and then make appropriate windage adjustments to compensate for cross winds.

The scope is particularly useful under open range conditions or when visibility is particularly good. There the hunter may be afforded the opportunity to carefully scope and visually track his prey until exact targeting is achieved.

However, such scopes are too cumbersome and impractical for use by hunters and others such as law enforcement officers operating in close-range firing situations, where quick and accurate aim is critical. Where visibility is limited by weather or by dense brush such as that typically encountered in the Southern United States, for example, the hunter will not have the opportunity to carefully visually track his target for any extended period. Typically, a deer or other prey will suddenly appear out of the brush, and the hunter will have one opportunity to aim and fire as quickly as possible before the prey disappears again into the dense bushes. The first shot must therefore strike directly on target and produce a kill, so that the deer will not escape injured to die a slow and painful death in the brush. Hence, under such circumstances, quick, unencumbered, and accurate aim is extremely important.

Close-range, quick-fire accuracy is also very important to the law officer engaged in handgun combat. The law enforcement officer may have only a brief view of his assailant. The officer will rarely have time or opportunity to carefully contemplate his aim before firing. The failure to quickly aim and fire at short range could result in the escape of the assailant or the death of the officer. Hence, it can be extremely important that the officer's weapon be equipped with a highly accurate and extremely reliable quick-sighting devices.

Laser aiming devices have been employed in recent years to improve firing speed and accuracy. However, it has proven difficult to adapt laser aiming devices to use with conventional weapons. Laser beam emitter tubes are delicate and highly sensitive instruments. They may be easily damaged by careless handling and exposure to the elements. Additionally, the extreme recoil shock produced by conventional hunting weapons and handguns may severely affect fine laser aiming adjustments and may completely disable the aiming device. Finally, as with the introduction of any new technology, the introduction of laser aiming devices for use with hunting weapons required hunters to learn new sighting methods. To achieve best results in all conditions, a hunter must develop competence in the alternate use of both optical sighting and laser aiming techniques.

Laser aiming devices are typically mounted parallel to the barrel of a weapon such as a rifle or handgun. Conventional gas lasers typically comprise an elongated laser tube containing a helium-neon or other gaseous medium. The gas imparts optical regenerative gain (or "light amplification") to light traveling along the laser tube. Pairs of lenses or mirrors mounted at either end of the gas tube reflect the light back and forth in the tube until it becomes a high-energy coherent beam. The beam illuminates a reference spot or point on the target surface. These non-refractive laser beams are capable of returning a red signal from long distances, typically between five and eight hundred feet.

When the laser aiming unit has been properly preadjusted for a predetermined range, the light beam converges with the line of fire and the hunter's line of vision at the target point, so that the hunter may merely "spot" the target by aiming the red beam on the desired strike point before firing. Thus, the hunter is free to brace the weapon with his hand, shoulder, hip, or in any other convenient position while visually sighting his close-range target without a scope or other intermediate optical sighting device associated with the weapon. This freedom is particularly important for close-range, quick-strike firing such as is practiced in dense brush hunting or in hand combat.

Numerous laser aiming devices have been proposed in the prior art for use with hand-held weapons of various types. The development of the laser art is outlined in detail by Matthews in the prior art disclosure of his U.S. Pat. No. 4,313,272, issued Feb. 2, 1982. For purposes of this discussion, the Matthews '272 disclosure is incorporated by reference herein. As indicated therein, much of the early art was directed to providing adequate recoil shock resistance for the laser emitter. For example, various shock-resistant mountings are proposed by Snyder, in U.S. Pat. No. 4,026,054, issued May 31, 1977; U.S. Pat. No. 4,079,534, issued Mar. 21, 1978; U.S. Pat. No. 4,161,076, issued July 17, 1979; and U.S. Pat. No. 4,295,289, issued Oct. 20, 1981.

Each of the above referenced patents relates to laser aiming devices for conventional weapons which incorporate mechanically yieldable shock-absorbing mechanisms to prevent damage from recoil shock. Snyder also proposes quick-change mounting means for mounting interchangeable laser units onto different types of weapons. Very modern laser devices employ solid-state laser emitters, so that such shock-absorption devices are less critical.

Another line of related prior art patents is directed more specifically to the development of laser mounts which provide accurate elevation and windage adjustments Earlier systems applied technology developed for optical scope mounts such as those disclosed by Heinze in U.S. Pat. No. 3,040,433 issued June 26, 1962 and Ivy in U.S. Pat. No. 2,645,855 issued July 21, 1953. Typical scope mounts employ a plurality of cooperating screws which contact the outer periphery of the front and rear ends of the scope. By tightening or loosening various screws, the scope may be realigned for elevation and windage adjustments.

However, because the laser emitter tube is such a delicate instrument and because close-range accuracy from any number of firing positions is important, these prior art scope mounting systems have proved inadequate. A patent more specifically applicable to laser adjustment systems is Matthews U.S. Pat. No. 4,313,272, issued Feb. 2, 1982. The delicate laser emitter tube is securely housed within a rigid casing associated with the gun barrel. Within the casing, the laser tube is captured between cushioned block members which may be mechanically raised or lowered for elevation adjustments. Matthews also proposes alternatively the use of optical beam deflecting prisms for fine elevation and/or windage adjustments. In the latter-referenced system, a pair of wedge-shaped prisms are mechanically rotated to redirect the exiting laser beam. The last-referenced system, however, is very sensitive and expensive, and thus impractical for hunter's purposes.

Kaelin U.S. Pat. No. 4,244,131 issued Jan. 13, 1981, discloses a laser mounting system in which vertical and horizontal adjustments are facilitated by manipulation of the entire laser housing relative to the gun barrel rather than movement of the laser emitter tube within the housing. The Kaelin '131 laser housing also encloses the battery power system. While the system is rugged and readily adapted for use with heavier weapons such as submachine guns, it is too large and cumbersome for use with smaller weapons such as handguns, compound bows, and hunting rifles. Finally, Kaelin's system is incapable of the extremely fine elevation and windage adjustments required for close-range hunting.

U.S. Pat. No. 4,571,870, issued to Heidemann on Feb. 25, 1986, describes a quick-release laser aiming mount for use with a rifle. The mount comprises front and rear rings which axially engage the rifle barrel and are mechanically linked to a tubular bracket which supports the laser unit below the rifle barrel. A calibrated thumbscrew associated with the front ring provides elevational adjustment. A spring-biased thumb wheel associated with the rear of the mount facilitates windage adjustments. The device is not readily adaptable for use with different types of hunting weapons. The main disadvantage associated with the '870 system, however, is that the screw-controlled adjustment system is incapable of providing extremely fine adjustments as are needed in close-range situations.

It will be appreciated that the precision of aiming adjustment achieved in such mounting systems is directly related to the size and spacing of the set screw threads. Some laser systems known to us are equipped with very fine adjustment screws having eighty threads per inch. However, based on our experience, an 80-thread screw turned 1/24th of a turn may move the line of aim one half to one inch at one hundred yards. This produces a substantial aim error which could result in loss of the prey in close, quick-fire situations.

Finer thread screws having eighty-four threads per inch have been used in some laser aiming devices. However, it is our experience that these very fine threads are so delicate that they are incapable of maintaining proper position when exposed to shock from recoil or rough handling of the weapon. Screw threads have been machined as far as possible by present experience and understanding of the art. Hence, it is desired to produce a more reliable, precision adjustment system for laser aiming devices which can achieve very precise adjustments for close-range firing, and which remain true despite shock experienced from rough handling, recoil shock, and unfavorable environmental conditions.

None of the prior art laser aiming systems known to us permit the alternative use of the laser aiming system with an optical sighting system such as a scope. Because scopes are equipped with outwardly protruding windage and elevation adjustment knobs, a laser scope could not be mounted directly upon or around a rifle scope without interfering with the use of the scope. Moreover, no prior art laser aiming device is adapted to be used on various different types of weapons such as rifles, shotguns, and hunting bows.

Hence it is desired to provide a laser aiming system which is durable and readily adapted for use with different types of hunting weapons used in close-range, quick-fire situations. It is required that such a system be capable of precision adjustments in laser sight aiming. Further, such a system should be capable of use with telescopic sights of varying types and diameters.

SUMMARY OF THE INVENTION

Our invention comprises a highly accurate laser aiming device, primarily for firearms, which can be quickly and easily mounted upon a firearm either with or without a scope, and which facilitates ultra-fine elevation and windage adjustments. Our system may be used by a hunter in conjunction with a hand-held hunting weapon such as a rifle, a shotgun, a compound bow, a crossbow, a handgun, or a muzzleloader. Our system facilitates very fine, delicate sighting aim adjustments to its laser, so that complex sighting adjustments may be made in the field, and bullet trajectory, scope sighting, and the laser light path can all be finely tuned and properly coordinated for precision, laser-guided shooting.

When properly mounted and adjusted, the laser aiming device projects a high-intensity laser beam which illuminates a red dot on the surface of the sighted target exactly at the desired point of bullet impact. The present device is particularly well adapted for close-range firing where visibility is limited, such as in dense brush, and in twilight, overcast, or other low-light conditions. The device permits the hunter to quickly and accurately aim and fire from any position virtually as soon as the prey is spotted, so that the prey is not lost.

The device comprises an elongated laser housing operatively linked to a power pack assembly. A quick-release mounting system permits the hunter to semi-permanently securely mount the laser housing and power pack to the body of the firearm or upon an existing optical telescope sight. Unique internal wedge-actuated adjustment means facilitate extremely accurate windage and elevation adjustments which are particularly critical for close-range firing.

The laser housing adjustably mounts an internally disposed laser emitter tube which is powered by the preferably rechargeable power pack assembly. The laser emitter tube is preferably anchored within a tubular sleeve axially, adjustably disposed within the laser housing. The sleeve comprises an elongated, tab-equipped tube adapted to be coaxially fitted and retained within the housing.

The laser beam must be exactly aimed to properly converge with the line of fire of the firearm. Positioning of the laser beam is facilitated by the present "wedge-equipped" adjustment assembly. Very fine elevation and windage adjustments of the aiming device are facilitated by unique, thumbscrew-driven wedge members within the housing which physically contact and urge against the laser sleeve. The elevation wedge disposed within the top of the housing slides against a suitable inclined plane formed in the top of the sleeve. As the elevation wedge moves axially it deflects the sleeve, overcoming bias from an elevation spring member disposed within the housing in contact with the sleeve underside.

"Windage" or horizontal adjustments of the laser tube are controlled by a similar windage-compensating wedge radially spaced apart from the elevation wedge by ninety degrees. When moved axially within the housing, the latter wedge contacts an inclined plane on the sleeve, and thus deflects the laser tube against predetermined bias from a windage spring in contact with the sleeve on its opposite side. The resultant laser tube deflection effectuates windage compensation. Extremely precise adjustments to within one-sixteenth inch at one hundred yards may be achieved by employment of the present system. A locking mechanism associated with the thumbscrew provides an audible click to signal one turn of the adjustment thumbscrew.

The preferred mounting system comprises pairs of rigid, generally C-shaped clamps associated with the laser housing and the power pack assembly. The upper end of each clamp engages a mounting channel defined along the lower edge of the laser housing or the power pack assembly. The lower end of each clamp engages the angular edges of a conventional scope slide. Screws penetrate the clamp and the laser housing body to permit the hunter to secure the clamp against undesired longitudinal movement upon the scope mount. By loosening the screws, the hunter may reposition or quickly remove the scope as desired.

Where it is desired to use the present laser device in conjunction with an existing scope, the laser housing may be mounted upon a novel scope ring assembly defined herein. The scope ring assembly is adapted to be axially secured to an existing scope. The scope rings define a mount bar configured as a conventional dovetail scope mount. The clamps associated with the laser housing conveniently slide onto the scope ring mount bar and are secured at the desired position by tightening the screws. The scope ring assembly is adjustably adapted to fit upon any of a plurality of optical scopes, ranging from 32 mm. to 1.0 inch in diameter.

Hence it is a broad object of the present invention to provide a highly accurate laser aiming device for firearms.

A related object is to provide a laser aiming device which quickly and easily retrofits to a variety of existing sporting arms, and which may be employed with or without telescopic sights.

A similar object is to provide a laser aiming device of the character described adapted for use with hand-held hunting weapons used for close-range, fast-action firing.

Another broad object of the present invention is to provide a laser aiming device which may be adapted for use on a wide variety of hunting weapons, including bows, crossbows, rifles, shotguns, and handguns.

Another fundamental object of the present invention is to provide a laser aiming device for firearms which facilitates extremely accurate and reliable windage and elevation adjustments.

A further object of the present invention is to provide a laser aiming device of the character described which may be conveniently mounted for use in conjunction with a conventional optical scope sight.

Still another object of the present invention is to provide a laser aiming device of the character described which operationally facilitates easy and accurate windage and elevation adjustments.

An additional object of the present invention is to provide a laser aiming device of the character described which may be conveniently mounted on the slide bar of a conventional rifle mount or upon a pre-mounted optical scope.

Yet another object of the present invention is to provide a laser aiming device of the character described which incorporates an extremely reliable, precision adjustment system which can endure shock resulting from rough handling, weapon recoil, and unfavorable environmental conditions.

Another object of the present invention is to provide a laser aiming device of the character described which incorporates a quick-connect mounting system for use on a plurality of different types of firearms.

An advantageous feature of the present invention is that its modular construction permits it to be mounted upon a conventional optical scope without interfering with the operation or adjustment of the scope.

A more specific object is to provide a laser system of the character described capable of providing precision elevation and windage adjustments of one-sixteenth inch at one hundred yards range.

Another object is to provide a laser system of the character described having scope rings adjustably adapted to fit a plurality of optical scopes ranging from 25 mm. to 30 mm. diameter.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
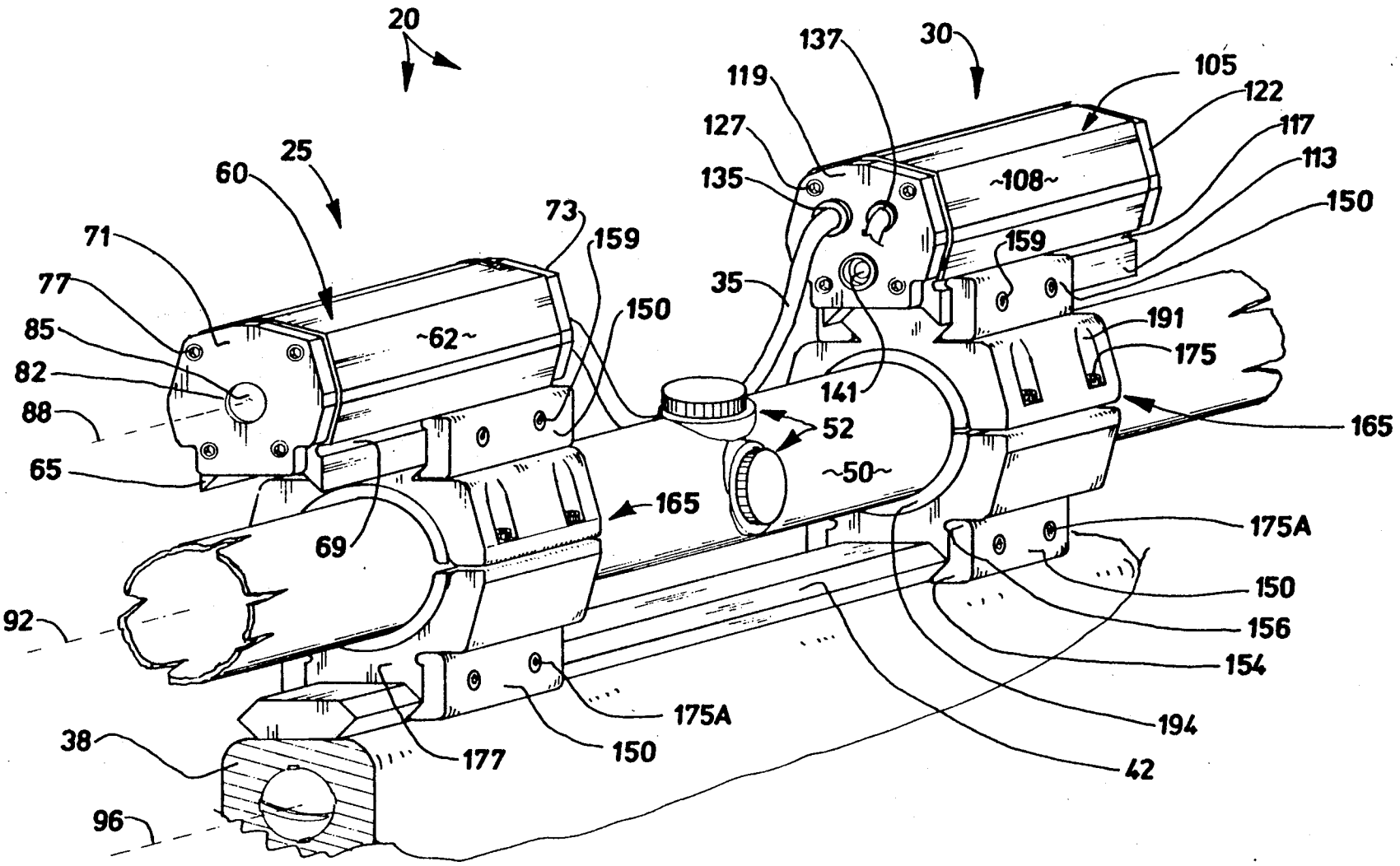
FIG. 1 is an isometric, environmental view illustrating the best mode of our MODULAR LASER AIMING SYSTEM in use in conjunction with a conventional scope-equipped hunting rifle.

With initial reference to FIG. 1 of the appended drawings, the best mode of our modular laser aiming system is generally designated by the reference numeral 20. A hunter may mount the laser system 20 either directly to a firearm 38 or upon a conventional telescoping sight 50 in turn mounted to the firearm. Thus, the hunter may conveniently alternate between use of the laser aiming system 20 alone or with the optical sight 50.

System 20 is also adapted for convenient installation on a plurality of other types of hunting weapons, such as a compound bow, a crossbow, a shotgun, a pistol or a muzzleloader. When properly adjusted, the instant laser aiming system projects a distinctly visible spot of light on the target surface precisely at the point of projectile impact. Thus, the hunter may accurately aim and quickly fire while supporting the firearm from virtually any position, such as at his hip, his shoulder, his forearm, or upon some other supporting surface. Improved speed and accuracy greatly reduces aiming inaccuracies.

As illustrated in FIG. 1, the laser system 20 broadly comprises a laser module 25 and a separate power module 30 linked by a flexible power cable 35. This unique modular construction leaves the scope's conventional elevation and windage adjustments 52 unobstructed, so that the optical scope 50 may be used without removing laser system 20. Highly precision windage and elevation adjustments of the laser system 20 are accomplished by the unique adjustment system to be described in detail hereinafter.

With specific reference now to FIGS. 1-4 and FIG. 12, the laser module 25 comprises a rigid, protective housing 60. Housing 60 comprises an elongated, tubular, generally hexagonal body portion 62 integral with a downwardly extending base 65. Generally concave mounting channels 69 define a border between housing 60 and base 65 on either side of the laser module 25. The bottom of base 65 is angularly conformed to slidably mount upon a conventional dove-tail scope mount 42. Internally, housing 60 comprises a plurality of radially spaced-apart, longitudinally extending follower slots 68 (FIG. 12) which enable adjustable mounting of the operative laser assembly as described hereinafter.

Housing 60 is sealed by a front end cap 71 and a rear end cap 73 secured by a plurality of allen head nuts or similar anchors 77. Front cap 71 comprises a lens window 82 covered by a lens 85 of optical glass or similar material through which a light or laser beam represented by dashed line 88 (FIGS. 1, 9) is outputted. The system 20 is preferably installed so that line of sight defined by the light beam 88 at the rifle barrel is generally parallel to the line of sight projected through the scope, represented by dashed line 92, and to the line of projectile fire, represented by dashed line 96. When the laser aiming system 20 and the scope 50 are properly adjusted as described in detail hereinafter, sight line 88 and 92 should converge with the line of fire 96 at a predetermined distance corresponding to the position of the target, such as a deer or other prey.

The rear end cap 73 comprises an orifice for power cable 35, which is secured by a grommet or flexible bushing 99. Cable 35 operatively links the laser module 25 to the power module 30.

Figure 11:
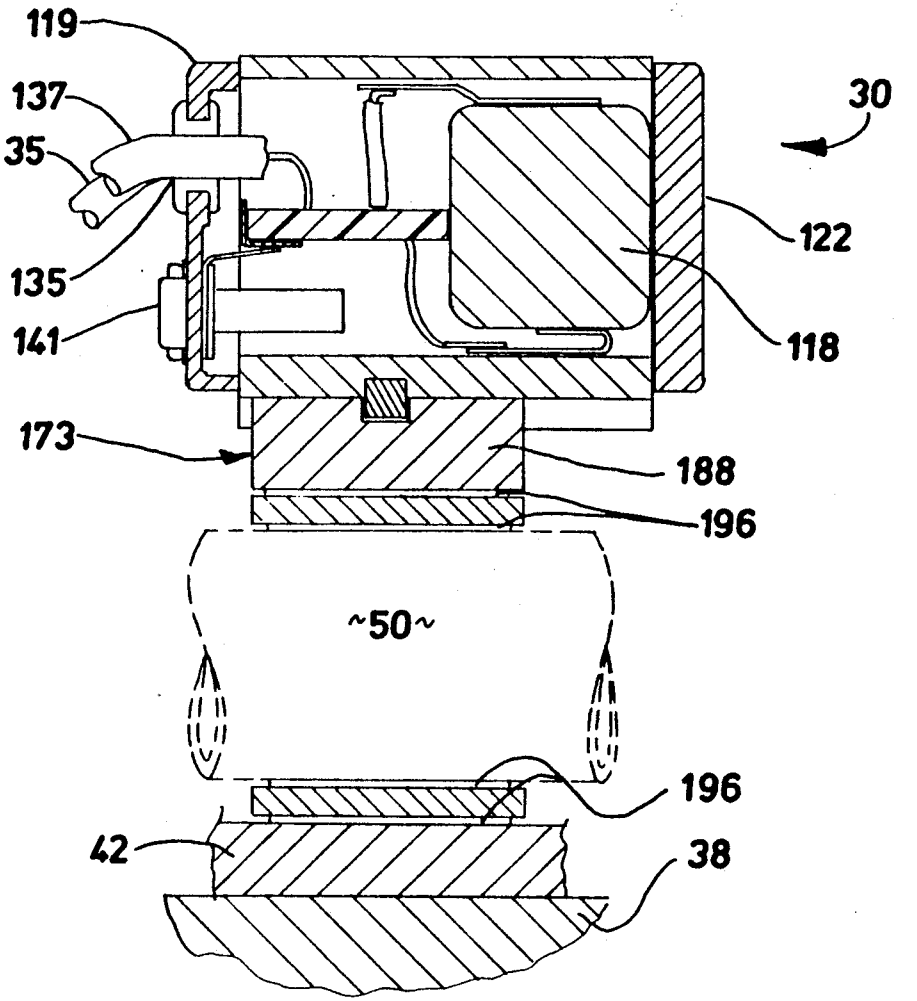
FIG. 11 is a fragmentary, sectional view taken generally along line 11—11 of FIG. 6; and, FIG. 12 is an exploded, isometric view of the preferred laser housing assembly with portions omitted for clarity.

With combined reference now directed to FIGS. 1 and 5-7, the power module 30 comprises a rigid, protective casing 105 similarly configured as laser housing 60 with a generally hexagonal, tubular body 108, an angular base 113, and generally concave mounting channels 117 defining a border between the body 108 and base 113. Casing 105 houses a preferably rechargeable power cell 118 (FIG. 11) and is sealed by a front end cap 119 and a rear end cap 122 secured by a plurality of bolts 127.

The front cap 119 comprises a power cable inlet orifice 135, an inlet for trigger cable 137, and a charger window 141. Trigger cable 137 links the internally disposed power cell 118 to a conventional power switch assembly associated with the firearm trigger (not shown). The charger window 141 permits the hunter access to the power cell 118 for recharging.

Modules 25, 30 may be mounted either upon the rifle barrel 38 on the conventional dove-tail scope mount 42 (FIGS. 4, 7) or upon a scope sight 50. Each module is slidably secured to the mount 42 by a pair of cooperating, elongated, rigid, generally C-shaped clamps 150. Each clamp comprises an angular base 154 which is slidably captured between mount 42 and rifle barrel 38. A rounded, generally convex jaw 156 associated with the upper end of the clamps 150 slidably engages module mounting channels 69, 117.

Figure 8:
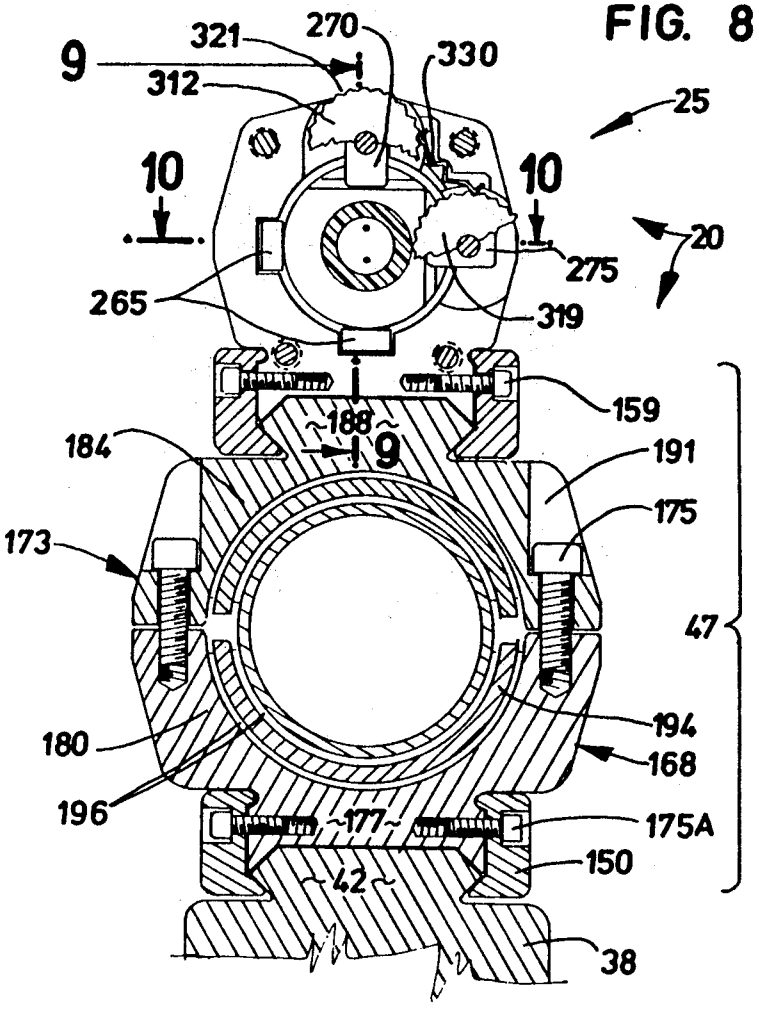
FIG. 8 is a fragmentary, sectional view taken generally along line 8—8 of FIG. 2.

The clamps 150 are preferably secured by a pair of screws 159 which penetrate the clamp body and terminate within base 65, 113 (FIG. 8). Thus, in order to mount or dismount the aiming system, the hunter must only remove screws 159 and slide the clamps 150 off of the mount. Mounting assembly 47 (FIG. 8) may also mount the laser system 20 to a conventional optical telescope sight 50.

With particular reference now directed to FIGS. 1, 2, 5, and 8, the mounting assembly generally designated by the reference numeral 47 comprises a plurality of scope rings 165. For purposes of clarity and brevity, this discussion shall be directed to one scope ring, and it shall be understood that all of the rings 165 employed comprise identical structure. Ring 165 comprises a lower shell 168 and a cooperating upper shell 173 adjustably joined by two pairs of bolts 175. Lower shell 168 comprises a base 177 angularly configured as module bases 65, 113 to slidably couple to mount 42 and receive clamps 150. The clamps 150 are secured by bolts 175A which extend through base 177 Extending upwardly, integrally from base 177 is a generally U-shaped cradle 180 which mounts the scope sight 50.

The cooperating upper shell 173 of rings 165 comprises a generally U-shaped scope cradle 184 terminating in an integral, upwardly extending, dove-tail mount 188. Recesses 191 defined on either side of cradle 184 protect access to bolts 175.

In the best mode, rigid shims 194 may be inserted between the ring cradle and scope to accommodate scopes of different sizes, ranging from 32 mm. (1.25 inches) to 25 mm. (one inch) in diameter. Shells 168, 173 are preferably lined with a resilient dampening pads 196 comprising a web of cloth tape, rubber tubing, or similar material. The pads 196 provide dampening from recoil shock and enhance the stability of the mount.

Figure 2:
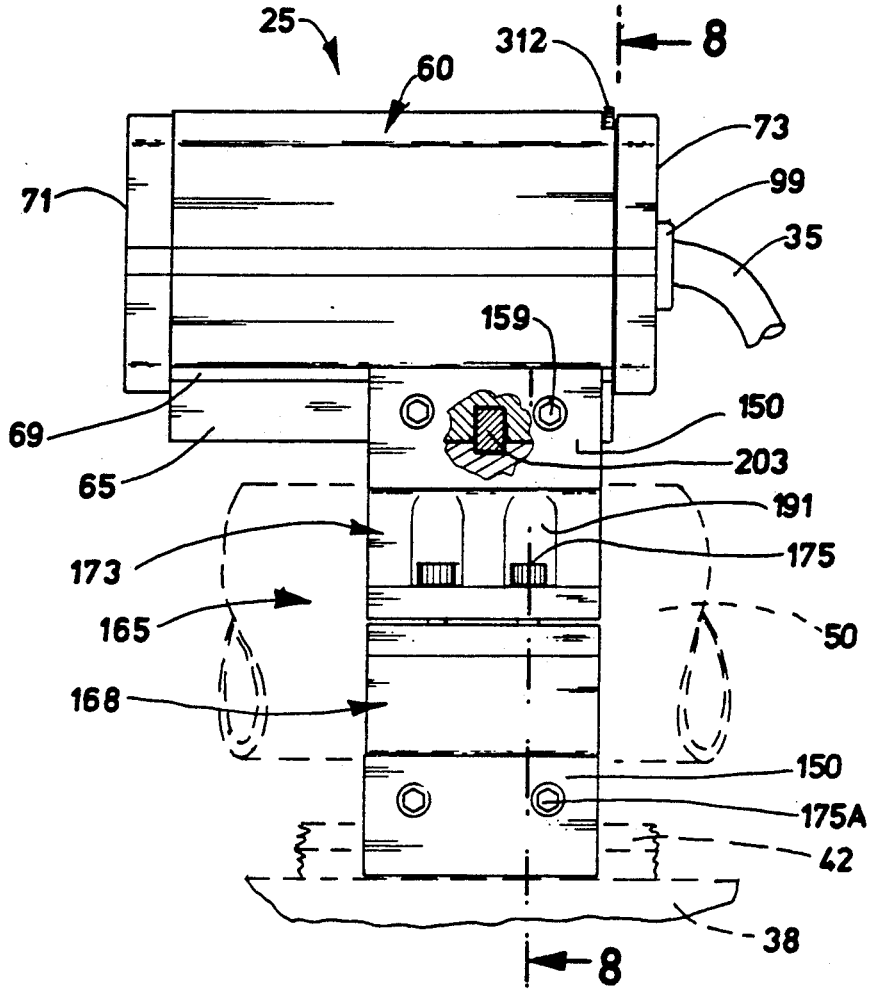
FIG. 2 is a greatly enlarged, fragmentary, side elevational view thereof, illustrating the preferred scope mounting assembly in association with the laser housing.
Figure 10:
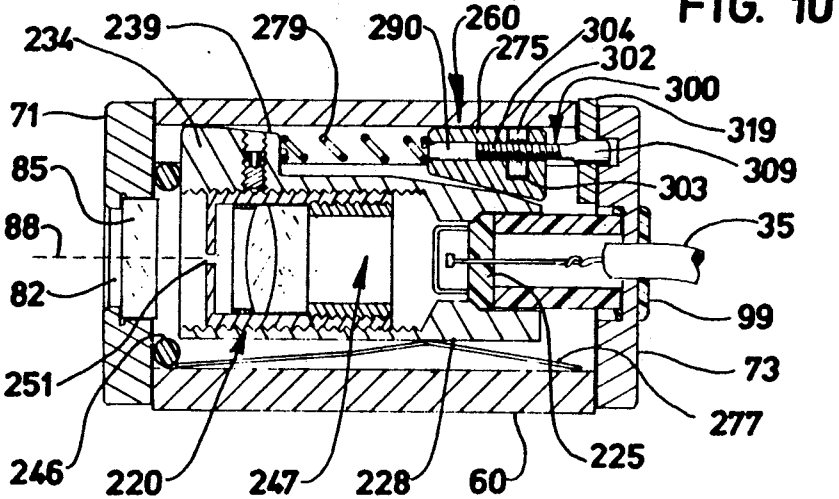
FIG. 10 is a fragmentary, vertical sectional view taken generally along line 10—10 of FIG. 8.

When the laser aiming system 20 is thus mounted upon a scope sight 50 or upon scope rings 165, recoil shock from the weapon may be translated upwardly through the mount rings 165 to jar the laser system 20. To dampen such shock and thus prevent damage or misalignment of the system 20, an elongated impact key 203 (FIGS. 2, 5, 12) preferably formed of CRS keystock or similar material is provided. Impact key 203 extends through a recess 204 (FIG. 12) defined through base 65 and a cooperating recess defined in mount 188 (FIGS. 2,10). Key 203 is secured by suitable bolts 205 (FIG. 10).

Figure 12:
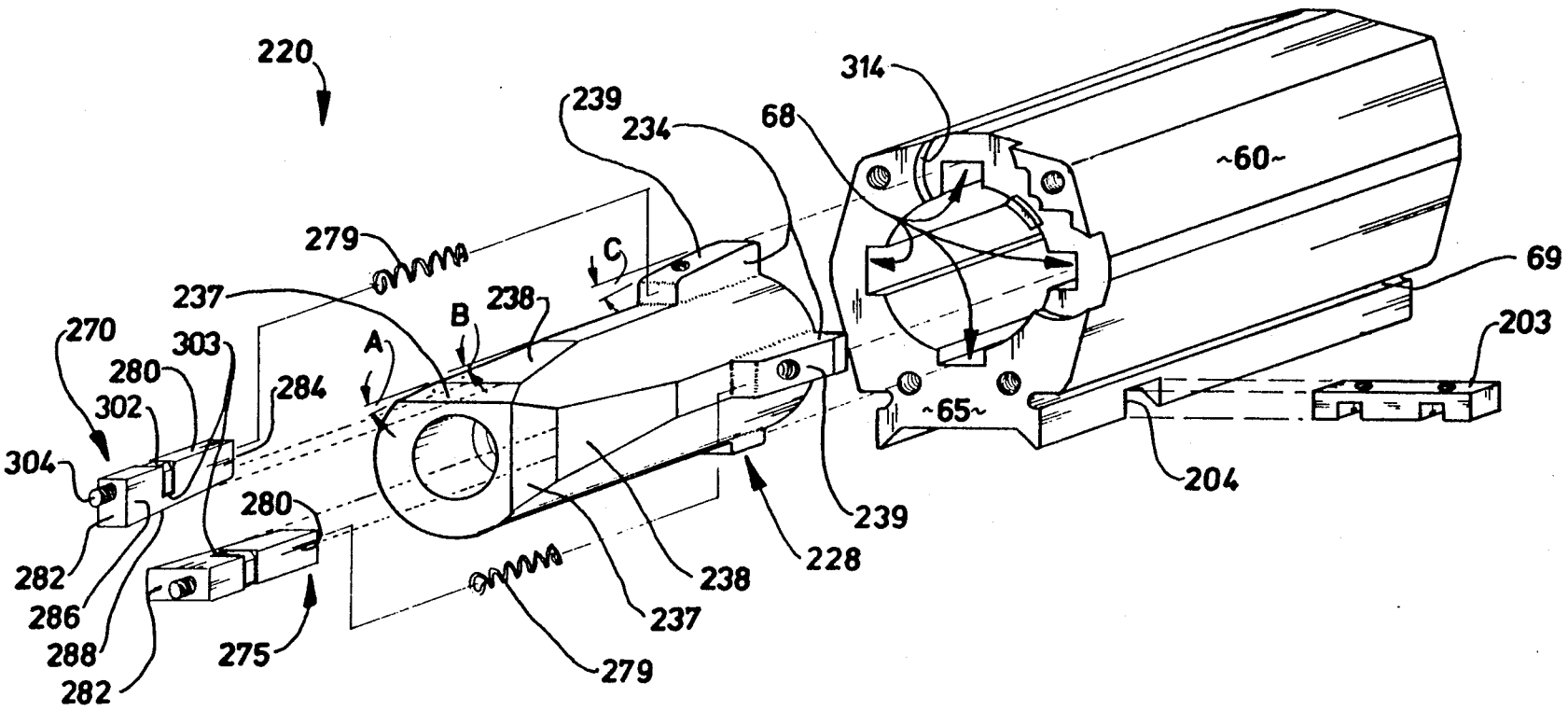

Thus, the laser aiming system 20 may be conveniently and safely mounted for use on a firearm or on a conventional optical scope. Either selective mounting will require the hunter to "sight in" the firearm 38 through appropriate elevation and windage adjustment of the laser system 20 before use. Extremely fine adjustments are possible by virtue of the present unique adjustment system associated with the operative laser assembly With specific reference now directed to FIGS. 8, 9, 10, and 12, the operative light-generating assembly disposed within housing 60 is broadly designated by the reference numeral 220 (FIG. 12). The assembly 220 comprises a light-emitting diode or solid-state laser tube 225. Light 225 is securely mounted within an elongated, generally tubular sleeve 228.

As best viewed in FIG. 8–10 and 12, sleeve 228 comprises a plurality of radially spaced-apart, outwardly extending tabs 234 which slidably mount within the follower slots 68 of housing 60. The outer surface of sleeve 228 is asymmetrically planed to define a plurality of inclined planes. In the best mode of our invention, a first pair of planes 237 extends toward the front of sleeve 228 to define an angle A of approximately eighteen degrees between the sleeve and the laser housing. A second pair of planes 238 extends rearwardly to define an angle B of roughly eight degrees between the sleeve and laser housing. A third pair of planes 239 defines an angle C of roughly five degrees between tabs 234 and the laser housing 60.

Figure 9:
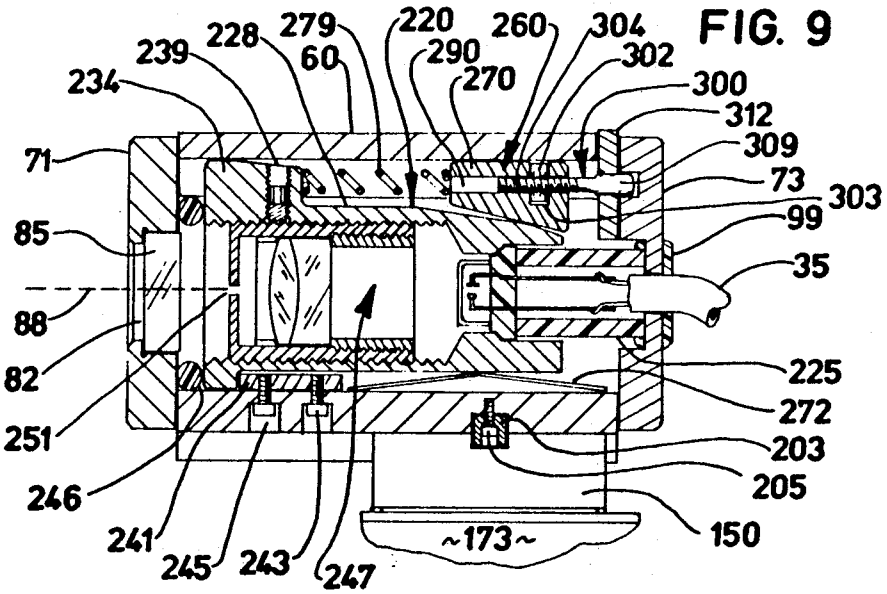
FIG. 9 is a fragmentary, longitudinal sectional view taken generally along line 9—9 of FIG. 8.

Sleeve 228 is secured within the laser housing 60 by a rigid stop 241 (FIG. 9). Stop 241 firmly abuts sleeve 228 and is secured by bolts 243 which penetrate laser housing 60 and are protected from access by counterbores 245 (FIG. 9). Stop 241 prevents gross displacement of sleeve 228 as a result of recoil shock or other impact. Additional recoil dampening is provided by a resilient O-ring 246 axially mounted upon the front end of sleeve 228 and associated with light window 82.

Sleeve 228 comprises an internal light chamber 247 which terminates in a generally circular port 251. When the light 225 is activated, beam 88 is outputted through chamber 247, passes port 251, and exits window 82. Preferably the beam 88 is aligned generally parallel to the line of fire 96 at the barrel. In accordance with the present adjustment system, the line of sight of beam 88 may be adjusted for firing within a predetermined range by tilting the sleeve 228 horizontally or vertically relative to housing 60. Broadly, vertical tilting of sleeve 228 results in "elevation" adjustments, while horizontal movement of the sleeve produces "windage" adjustments.

Such adjustments are facilitated by a pair of rigid wedge assemblies broadly designated by the reference numeral 260 and cooperating springs generally indicated by the reference numeral 265 (FIG. 8). A first "elevation" wedge 270 associated with the top of sleeve 228 cooperates with elevation spring 272 associated with the bottom of sleeve 228 to facilitate elevation adjustments (FIG. 9). Elevation spring 272 is captured between stop 241 and rear end cap 73 along the floor of the laser housing.

A second "windage" wedge 275 associated with one side of sleeve 228 cooperates with windage spring 277 associated with the opposite side of sleeve 228 to permit windage adjustments (FIG. 10). Windage spring 277 extends between end caps 71, 73 along the side of the laser housing. Sleeve 228 is resiliently retained within the laser housing 60 between springs 272, 277 and cooperating wedges 270, 275. Additionally, resilient backlash springs 279 longitudinally bias wedges 270, 275. (FIGS. 8, 9). This resilient mounting arrangement prevents damage to the laser diode 225 from recoil shock or other impacts from rough handling which might otherwise result in maladjustment or malfunction of the laser assembly The wedges 270, 275 comprise identical structure and function in virtually the same way. Thus, for purposes of brevity and clarity in this discussion, reference will be directed to the elevation wedge 270 and elevation spring 272, and it shall be understood that the structure of the windage wedge 275 and windage spring 277 is also generally described.

As best illustrated in FIG. 12, the elongated, rigid, block-like wedge 270 comprises a top surface 280, a front panel 282, a rear panel 284, a pair of opposing sides 286, and a lower surface 288. Front and rear panels 282, 284 are generally parallel, as are sides 286. Wedge top 280 defines a flat plane generally perpendicular to sides 286 and ends 282, 284. Lower surface 288 defines an angle of roughly thirteen degrees between front 282 and rear 284. Thus, the height of rear panel 284 of wedge 270 is roughly one-half the height of front panel 282. Windage wedge 275 is similarly constructed, except that it is rotated sideways and oriented so that its top and bottom are parallel, and one side panel 286 tapers inwardly. Hence, the rear panel of wedge 275 is roughly one-half as wide as its front panel.

Figure 3:
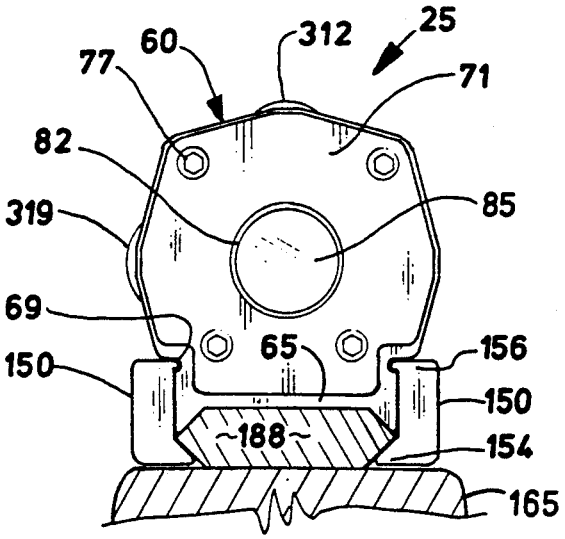
FIG. 3 is a fragmentary, front elevational view of the laser housing.
Figure 4:
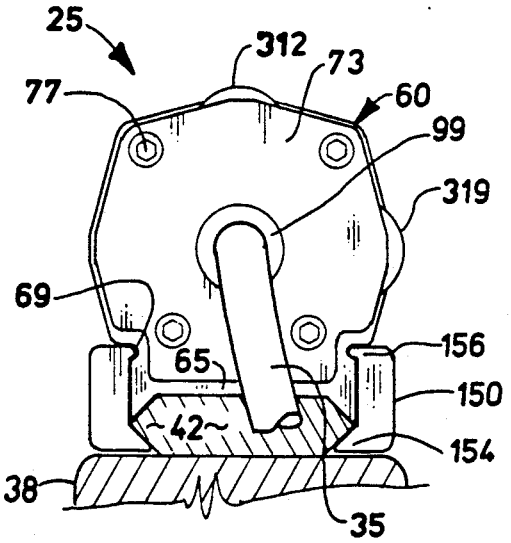
FIG. 4 is a fragmentary, rear elevational view of the laser housing, illustrating the laser housing mounted directly to the rifle.
Figure 5:
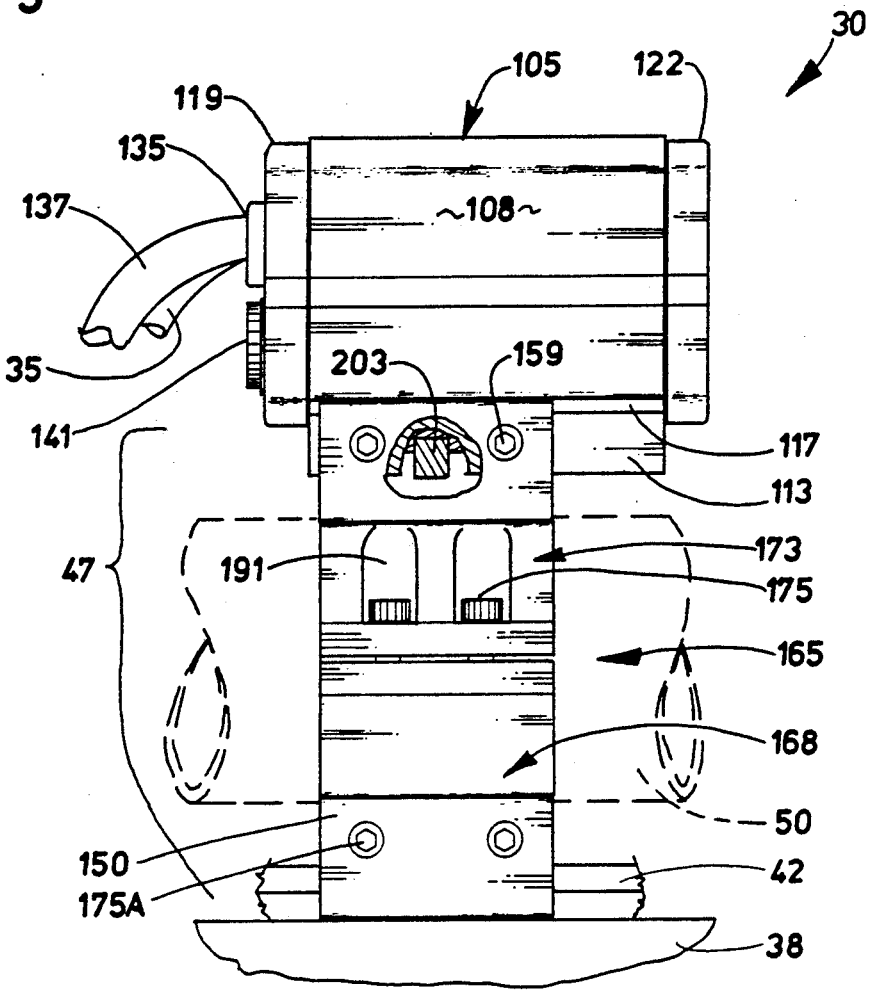
FIG. 5 is a greatly enlarged, fragmentary, side elevational view of a scope-equipped system as in FIGS. 1-3, illustrating the preferred scope mounting for the power pack.
Figure 6:
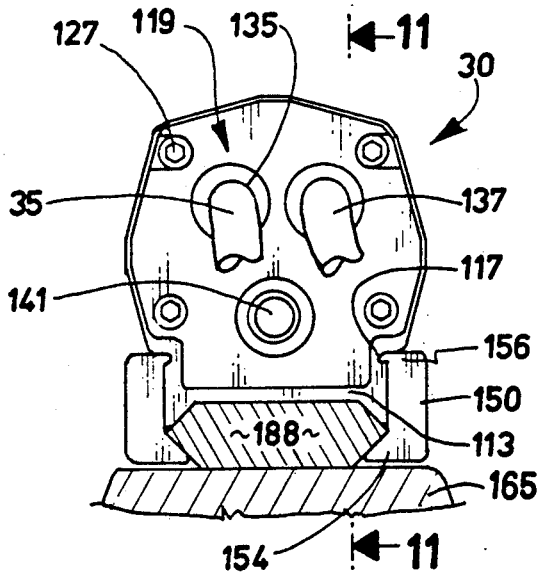
FIG. 6 is a fragmentary, front elevational view of the power pack.
Figure 7:
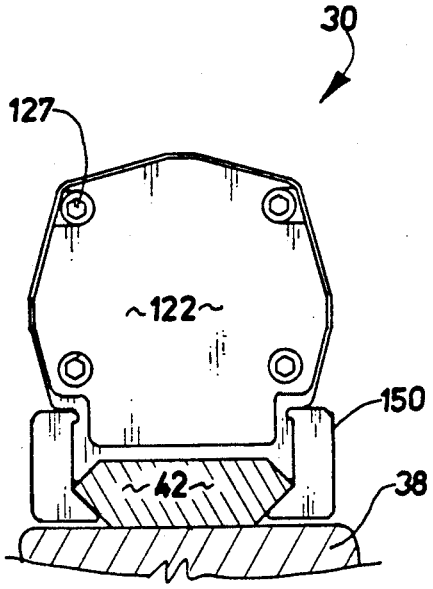
FIG. 7 is a fragmentary, rear elevational view of the power pack, illustrating the power pack mounted directly to the rifle.

A smooth bore 290 extending longitudinally through wedge 270 mounts an adjustment screw generally designated by the reference numeral 300. Screw 300 cooperates with threaded nut 302 which is retained in slot 303. Screw 300 preferably comprises a seventy-two thread bolt 304 terminating at its outer end in an enlarged head 309, which is captivated by a ratchet-controlled adjustment thumbscrew 312. As best viewed in FIGS. 8–10, thumbscrew 312 extends upwardly outwardly through slot 314 (FIG. 12) in housing 60. The thumbscrew 312 is thus conveniently accessible at the top of the laser housing 60. A similar thumbscrew 319 associated with the windage wedge 275 extends outwardly through the side of laser housing 60 (FIGS. 3, 8). The thumbscrews 312, 319 preferably comprise detente wheels having twenty-four notches 321 (FIG. 8) corresponding to pre-defined distance settings. In the best mode, each notch is calibrated to provide an adjustment of six mm. at 100 yards.

Adjustment screw 300 functions essentially as a worm gear to axially drive wedge 270 forward or backward along bolt 304 and thus urge the wedge 270 along the intersection of inclined planes 237, 238 of sleeve 228. When the thumbscrew 312 is rotated, bolt 304 rotates to drive the wedge 270 against backlash spring 279 along the intersection of corresponding inclined planes 237, 238. As the wedge drives deeper into the housing, its wider front portion contacts the intersection of inclined planes 237, 238 and urges sleeve 228 downwardly against resilient elevation spring 272. Elevation spring 272 exerts an opposing upward force against sleeve 228, thus resiliently retaining the sleeve in the desired position when the firearm is properly sighted in. Spring 279 biases elevation wedge 270 to retain it in the desired selective position. When the thumbscrew 312 is rotated in the opposite direction, the wedge is drawn forward so that the elevation spring 272 urges sleeve 228 upwardly. Upward and/or sideways tilt of the sleeve is limited to roughly five degrees, as tilt plane 239 is pressed into contact with housing 60.

With reference to FIG. 8, a tensioned ratchet strip 330 extends between the elevation and windage thumbscrews 312, 319. Strip 330 is crimped at either end to fit within one of the notches 321 of the adjustment thumbscrews 312, 319. Strip 330 biases the thumbscrews against free rotation. In addition, strip 330 produces an audible "click" each time the thumbscrew is rotated. Thus the hunter familiar with the operation of the system 20 can audibly discern the amount of windage or elevation adjustment achieved.

Hence, because windage and elevation adjustments are not limited by the number or fineness of the adjustment screw threads, extremely accurate elevation and windage adjustments are possible. Based upon our experimentation, an adjustment of one "click" of the thumbscrew of the present system will result in an adjustment of six mm. in the bullet impact point at one hundred yards. In conditions where quick, accurate firing is critical, such a fine adjustment can make the difference between a strike and a miss.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A light aiming system for a firearm, said system comprising:

rigid, generally tubular housing means adapted to be fitted to said firearm for mounting said system;

light means for selectively outputting a beam of substantially coherent light from said housing means toward a desired target at which said firearm is to be aimed;

sleeve means for securing said light means, said sleeve means generally concentrically disposed within said housing means and comprising a first inclined plane and a second inclined plane;

adjustment means for properly sighting-in said system to facilitate accurate aiming of said firearm, said adjustment means comprising:

first wedge means slidably mounted between said sleeve means and said housing means in contact with said first inclined plane for pivoting said sleeve means in response to axial displacements thereof;

means for selectively axially displacing said first wedge means to pivot said sleeve means and effectuate elevation adjustments to said system;

second wedge means radially spaced apart from said first wedge means and slidably mounted between said sleeve means and said housing means and in contact with said second inclined plane for pivoting said sleeve means in response to axial displacement of said second wedge means; and, means for selectively axially displacing said second wedge means independently of said first wedge means to pivot said sleeve means and effectuate windage adjustments to said system.

2. The light aiming system as defined in claim 1 wherein said system comprises elevation spring means for contacting and biasing said sleeve means toward said first wedge means and windage spring means for contacting and biasing said sleeve means toward said second wedge means.

3. The light aiming system as defined in claim 2 wherein said housing means comprises a plurality of radially spaced apart, internally defined longitudinally extending follower slots, and said sleeve means comprises tab means for registering within preselected ones of said slots.

4. The light aiming system as defined in claim 3 further comprising rigid stop means for securing said tabs within said follower slots to fasten said sleeve means within said housing means.

5. The light aiming system as defined in claim 2 including manually rotatable thumbscrew means for axially displacing said first and second wedge means to effectuate elevation and windage adjustments respectively.

6. The light aiming system as defined in claim 5 further comprising lock means associated with said first and second thumbscrew means for securely retaining each of said wedge means in a desired position.

7. The light aiming system as defined in claim 6 wherein said system comprises generally tubular power pack means adapted to be fitted to said firearm in spaced apart relation from said housing means for powering said laser aiming system.

8. The light aiming system as defined in claim 2 further comprising resilient dampening means disposed within said housing means for shock proofing said sleeve means and thus said light means.

9. The light aiming system as defined in claim 2 further comprising clamp means for semi-permanently mounting said system to said firearm.

10. The light aiming system as defined in claim 9 wherein said clamp means further comprises a pair of adjustable rings adapted to mount said system upon an optical rifle scope.

11. The light aiming system as defined in claim 10 wherein said system comprises generally tubular power pack means adapted to be fitted to said firearm in spaced apart relation from said housing means for powering said laser aiming system.

12. A laser aiming system for firearms adapted to be integrated with conventional telescopic sights which are designed to be coupled to conventional rifle scope base plates and which comprise optical windage and elevation adjustments, said laser aiming unit comprising:

a power module for powering said aiming system comprising a voltage source disposed within a rigid, protective enclosure;

a laser module comprising rigid, tubular housing means having a base, rigid, tubular sleeve means generally concentrically disposed within said housing means, and laser means disposed within said sleeve means for outputting a laser beam in response to activation by said power module;

mounting means for semi-permanently coupling said power module and said laser module to said telescopic sight on opposite sides of the sight's windage and elevation adjustments; and, means for properly sighting-in said system to facilitate accurate targeting of said firearm concurrently with proper use of said scope, said last mentioned means comprising:

first wedge means slidably mounted between said sleeve means and said housing means for pivoting said sleeve means in response to axial displacement thereof;

means for selectively axially displacing said first wedge means to pivot said sleeve means and effectuate elevation adjustments to said system;

second wedge means radially spaced apart from said first wedge means and slidably mounted between said sleeve means and said housing means for pivoting said sleeve means in response to axial displacement thereof; and, means for selectively axially displacing said second wedge means independently of said first wedge means to pivot said sleeve means and effectuate windage adjustments to said system.

13. The laser aiming system as defined in claim 12 wherein said sleeve means comprises a first inclined plane adapted to be contacted by said first wedge means and a second inclined plane adapted to be contacted by said second wedge means.

14. The laser aiming system as defined in claim 13 wherein said housing means comprises a plurality of radially spaced apart, internally defined longitudinally extending follower slots, and said sleeve means comprises tab means for registering within preselected ones of said slots.

15. The laser aiming system as defined in claim 14 wherein said system comprises elevation spring means for contacting and biasing said sleeve means toward said first wedge means and windage spring means for contacting and biasing said sleeve means toward said second wedge means.

16. The laser aiming system as defined in claim 15 further comprising manually rotatable thumbscrew means for axially displacing said first and second wedge means to effectuate elevation and windage adjustments respectively.

17. The laser aiming system as defined in claim 16 further comprising lock means associated with said first and second thumbscrew means for securely retaining each of said wedge means in a desired position.

18. The laser aiming system as defined in claim 15 further comprising clamp means for semi-permanently mounting said system to said firearm, said clamp means comprising a pair of adjustable rings adapted to capture said scope.

19. The laser aiming system as defined in claim 15 wherein said power module and said laser module are detachably linked toward by a flexible power cable whereby said power module may be quickly and conveniently replaced or removed for recharging without dismounting said laser module.

20. The laser aiming system as defined in claim 12 further comprising rigid stop means for engaging said tabs to secure said sleeve means within said housing means.

21. The laser aiming system as defined in claim 20 further comprising resilient dampening means disposed within said housing means for shock proofing said sleeve means and thus said laser means.

* * * * *